US009003694B2

(12) United States Patent
Nusca et al.

(10) Patent No.: US 9,003,694 B2
(45) Date of Patent: Apr. 14, 2015

(54) MIXED TURF AND METHOD FOR ITS PRODUCTION

(75) Inventors: Roberto Nusca, Arena Metato (IT); Marco Volterrani, Arena Metato (IT)

(73) Assignee: Mar. Project S.R.L., Pisa (IT)

( * ) Notice: Subject to any disclaimer, the term of this patent is extended or adjusted under 35 U.S.C. 154(b) by 356 days.

(21) Appl. No.: 13/504,946

(22) PCT Filed: Oct. 30, 2009

(86) PCT No.: PCT/IB2009/007271

§ 371 (c)(1),
(2), (4) Date: Jul. 17, 2012

(87) PCT Pub. No.: WO2011/051744

PCT Pub. Date: May 5, 2011

(65) Prior Publication Data

US 2012/0279125 A1 Nov. 8, 2012

(51) Int. Cl.
*E01C 13/08* (2006.01)

(52) U.S. Cl.
CPC ..... *E01C 13/08* (2013.01); *E01C 13/083* (2013.01); *E01C 2013/086* (2013.01)

(58) Field of Classification Search
USPC ..... 428/17; 47/66.7, 73, 74, 9, 1.01 F, 56
See application file for complete search history.

(56) References Cited

U.S. PATENT DOCUMENTS

| | | | | |
|---|---|---|---|---|
| 3,513,062 | A * | 5/1970 | Vinicki | 428/17 |
| 4,396,653 | A * | 8/1983 | Tomarin | 428/17 |
| 5,462,778 | A | 10/1995 | Ishikawa | |
| 6,035,577 | A * | 3/2000 | Motz et al. | 47/58.1 R |
| 6,216,389 | B1 * | 4/2001 | Motz et al. | 47/58.1 R |
| 6,219,965 | B1 * | 4/2001 | Ishikawa et al. | 47/58.1 R |
| 6,247,267 | B1 * | 6/2001 | Motz et al. | 47/58.1 R |
| 6,495,236 | B1 | 12/2002 | Matthias | |
| 7,943,212 | B2 * | 5/2011 | Nusca et al. | 428/17 |
| 2007/0248773 | A1 * | 10/2007 | Nusca et al. | 428/22 |
| 2012/0189785 | A1 * | 7/2012 | Rossing et al. | 428/17 |

FOREIGN PATENT DOCUMENTS

| | | |
|---|---|---|
| EP | 1 857 593 | 11/2007 |
| KR | 10-0864276 | 10/2008 |
| WO | WO 2005/003463 | 1/2005 |

* cited by examiner

*Primary Examiner* — Kristen C Hayes
(74) *Attorney, Agent, or Firm* — Ladas & Parry LLP

(57) ABSTRACT

Turf (1) for sports, recreational activities and/or for ornamental purposes comprising a mat of flexible material (10) equipped with a first face (11) and a second face (12) opposite to each other. To the mat (10) a plurality of fibers (20) are connected of an artificial material in such a way that it forms an artificial turf (50) that protrudes from the first face (11). The turf (1) comprises, furthermore, a measured amount of a loose infill material (50), for example of granular type, distributed on the face (11) of the mat (10). The turf (1) comprises, furthermore, natural vegetable material, i.e. plants, belonging to one, or more plant species (30) put in the loose infill material (50) by means of sowing, transplantation of portions of plants, or a combination of the two solutions. The fibers of artificial material (20) have a profiled shape comprising a main blade (21) and at least one side wing (22). More precisely, the side wing (22) has a curved profile suitable for forming a channel (25) arranged substantially parallel to the main blade (21) in order to form a channel that is substantially parallel to said main blade, so that the profile of the channel partially or completely encircles the spaces that are occupied by water, roots and loose infill material, creating a water reserve for roots.

20 Claims, 7 Drawing Sheets

MIXED TURF AND METHOD FOR ITS PRODUCTION

FIELD OF THE INVENTION

The present invention relates to a mixed turf, i.e both artificial and natural turf, for sports activities, recreative activities, or for ornamental purposes. In particular, the mixed turf, according to the invention, can be used as a playing field for sports activities such as soccer, 5-a-side soccer, tennis, hockey, american football, golf, athletics, rugby, baseball and other sports that are normally played on a turf.

BACKGROUND OF THE INVENTION

It is well known that turfs for sports fields such as for soccer, hockey, cricket, rugby, etc. provide a natural turf grown on a ground or substrate. Natural turfs offer high aesthetical, technical and environmental performances.

However, with the use and with time, as well as with unfavourable weather conditions, the natural turf quickly wears and requires expensive maintenance work. Unless a worn natural turf is completely restored, the playing field is anaesthetical, irregular, and potentially dangerous for the users.

An intense activity, which normally concerns a sports field, worsens the turf characteristics after each use without enough time for the turf to recover. In particular, the playing field looses its planarity, uniformity and resistance of its substrates, affecting the athletic performances and endangering the athlets.

For these reasons, synthetic playing fields have been developed in the last years, having artificial grass blades and granular infill material, for example sand or resilient material, which present improved performances and steadiness of grip on the ground. Such artificial turfs can be installed on surfaces that are made of various materials, in particular asphalt, and stabilized inert material.

Artificial turfs have some technical drawbacks, among which a considerable superheating of the playing field in addition to environmental modifications with subsequent discomfort for the users. For avoiding the above described drawbacks combined systems have been proposed of mixed natural and artificial turf. A combined natural/artificial system is described in U.S. Pat. No. 6,145,248. It provides substantially a biodegradable substrate to which grass blades are connected of artificial material and onto which a layer is put of soil in which natural grass is sown. With time the roots of the grass expand and the biodegradable substrate disintegrates. Therefore, the roots reach the ground located underneath the substrate and radicate in it.

However, this solution is strictly bound to the availability of a ground and has strong applicative limits, because it cannot be used in case of surfaces where artificial turfs are usually installed.

Mixed turfs also exist, comprising both artificial fibres and natural fibres, i.e. plants, as described in WO2006008579 in the name of the same applicant. More precisely, such mixed turfs comprise a support of not biodegradable artificial material to which the fibres of artificial material are connected creating a synthetic turf. The synthetic turf, then, is filled with a loose infill material comprising different components, for example loose granules of rubber, plastic material, mineral material, organic material of vegetable origin, etc.

The loose infill material has in particular the function of keeping the fibres of artificial material substantially vertical. As above described, furthermore, the mixed turf comprises also natural fibres, i.e. plants, which can be put in the loose infill material through a sowing step, or a step of transplantation of plant portions belonging to at least one vegetable species that preform a quick vegetative development and give origin to a plurality of plants having roots arranged completely above the support.

Such mixed turf can be easily carried, rolled up, turned over, without fall of the loose infill material, and can be arranged in a desired moment on a desired support surface in such a way that can be immediately employed.

Other mixed turfs are described in KR100864276, in particular to provide mixed turf tiles.

However, the vegetable species that is present in the mixed turfs, as above described, can be subject to lack of water stress, owing mainly to the presence of the loose infill material that is highly draining and causes a quick outflow of irrigation water, dehydrating the plants of the vegetable species.

On the other hand, a too much frequent irrigation in the hot periods limits the use of the turf and causes dispersion of nutritive substances, and pollution of the underground.

SUMMARY OF THE INVENTION

It is therefore a feature of the present invention to provide a mixed turf that is capable of assisting a correct vegetative development of the plants in it present and a longer duration of the same with respect to the mixed turfs of the prior art, in particular assuring a quick and long lasting ability to be used. It is another feature of the present invention to provide a turf that has technical features that are optimal for playing sports such as soccer, five a side soccer, tennis, hockey, american football, golf, athletics, rugby, baseball, concerning elasticity of the field, ball rebound, capacity of absorbing shocks, resistance against pull and torsion caused by shoes, etc.

It is a further feature of the present invention to provide a mixed turf that can be easily carried, rolled up, turned over without being damaged, and laid in any desired moment on a support surface for immediate use for the above activities and/or purposes, as well as that can be easily removed and immediately reused.

It is a further feature of the present invention to provide a mixed turf that can bear also a heavy and concentrate activity on it without affecting its features.

These and other features are accomplished with one exemplary mixed turf for sports, recreational and/or for ornamental purposes comprising:

- a mat of flexible material, said mat comprising a first and a second face that are opposite to each other;
- a plurality of fibres of artificial material connected to said mat in such a way that is suitable for forming an artificial turf that protrudes from said first face;
- a loose infill material distributed on said first face, said loose infill material adapted to keep said fibres of artificial material substantially vertical;
- a natural turf comprising a plurality of plants belonging to at least one vegetable species, wherein said natural turf is radicated into said loose infill material between said fibres of artificial material; whose main feature is that at least one part of said plurality of fibres of artificial material has a profiled shape comprising:

- a main blade;
- at least one side wing that extends from said main blade, wherein said, or each, side wing has a curved profile in order to form a channel that is substantially parallel to said main blade.

This way, in each channel, after filling with the loose infill material a water reserve can be formed for the roots of the plants. In particular the profile of the channel partially or completely encircles spaces that are occupied by water, roots and loose infill material. The water is mainly stored in the channel and not drained away, creating indeed a water reserve for roots that lasts a longer time than in the mass of the loose infill material, which is a very draining material, and then keeps the humidity for less time.

In particular, the, or each, wing, comprises, in a direction transversal to the main blade:

- a proximal portion that is integral to the main blade;
- a distal portion that is arranged opposite to the proximal portion;
- a central portion that is set between the distal portion and the proximal portion.

Advantageously, the distal portion is adapted to be put in a position selected from the group comprised of:

- a position next to said proximal portion, or to said central portion, in this case said wing defining a mainly closed channel;
- a position next to said main blade, in this case said wing and said main blade defining a mainly closed channel;
- a position distant from the distal portion and from the central portion of the wing and from the main blade, in this case said wing defining an open channel.

Advantageously, at least one first and a second side wings are provided that extend from said main blade, said first and said second side wings defining respectively a first and a second channel that are arranged parallel to said main blade.

In particular, the first and the second face wings are arranged at opposite sides with respect to the main blade.

Preferably, the main blade has polygonal cross section. In this case, the first and the second face wings can protrude from opposite vertices of the polygonal cross section of the main blade.

In particular, the pitch between two adjacent fibres of artificial material that extend from said mat is set between 0.5 cm and 5 cm.

In a preferred exemplary embodiment of the invention, the plurality of fibres of artificial material of the artificial turf comprise:

- a first plurality of linear fibres;
- a second plurality of profiled fibres as above described, alternated according to determined criteria with respect to said linear fibres.

Advantageously, the loose infill material comprises at least one of the following materials:

- material in granules, or loose fibres, in particular of vegetable origin, or mixed with synthetic rubber;
- elastomeric material;
- organic material of vegetable origin;
- mineral material;
- or a combination thereof.

Advantageously, the loose infill material comprises at least one of the following layers:

- a layer of rubber material;
- a layer of mineral material, in particular sand, or gravel;
- a layer of organic material of vegetable origin.

Preferably, the organic material of vegetable origin is selected from the group comprised of: cork, coconut fibres, agave fibres, cereal husks, in particular rice husks, peat, ground wood, vegetable residues, agricultural and food residues, grape seeds (seeds of *vitis vinifera*), compost, devitalized seeds of vegetable species, organic conditioners, organic fertilizers, hoof and horn meal, roasted leather waste, vegetable waste, and normally a desired organic material of vegetable origin in granules and/or loose fibres. In particular, the organic material of vegetable origin is adapted to meet the ideal hydrologic conditions and provide the necessary nutritive substances for growing the vegetable.

In a particularly advantageous embodiment, said organic material of vegetable origin is selected from the group comprised of: coconut fibres, rice husks, cork.

Preferably, the rubber material is selected from the group comprised of:

- natural rubber, or caoutchouc,
- silicon rubber,
- SBR,
- EPDM,
- SBS,
- SEBS,
- TPU,
- or a combination thereof.

Preferably, the vegetable species that is used to provide the natural turf is selected from the group comprised of:

- a vegetable monocotyledone species;
- a vegetable dicotyledone species;
- or a combination thereof.

Advantageously, the mat has small drainage holes for the drainage of the rainwater, or irrigation water, but to avoid propagation of the roots through them.

In particular, the holes may have a diameter set between 1 mm and 15 mm, advantageously between 1 mm and 10 mm.

Advantageously, the density of the holes on the mat is set between 10 holes for $m^2$ to 10.000 holes for $m^2$.

In an exemplary embodiment of the invention the second face of the mat is coupled to a layer of spongy or impermeable material.

In case of spongy material having a measured porosity the roots penetrate through it assisting the stability of the mixed turf.

In case of impermeable layer, it prevents water to reach the surface of the cultivation site, or the installation site, of the mixed turf. Therefore, the vegetable species roots exclusively above the impermeable layer.

For example, the thickness of the layer of impermeable material can be set between 6 and 25 mm, advantageously between 8 and 20 mm, preferably between 10 and 15 mm.

Advantageously, the impermeable material is a polyurethane resin.

In an exemplary embodiment of the invention the mat comprises:

- an upper containing layer;
- a lower containing layer;
- a draining layer that is arranged between said upper containing layer and said lower containing layer, said draining layer distancing said upper containing layer from said lower containing layer, said fibres of artificial material being connected to said mat by weaving in order to cross said draining layer.

In particular, the draining layer can carry out, furthermore, a damping action. More in detail, the thickness of the draining layer is selected according to the needs and, in particular, of the desired damping action.

Preferably, the draining layer provides a three-dimensional network of interwoven filaments of plastic material, so that said interwoven filaments form a open and resiliently compressible layer.

In particular, the filaments of plastic material may have a diameter set between 0.2 and 1.5 mm, advantageously between 0.5 and 1 mm, preferably between 0.8 and 0.9 mm.

According to another aspect of the invention, a method for making a turf for sports, recreational activities and/or for ornamental purposes comprises the steps of:

arranging a mat of flexible material, said mat comprising a first face and a second face that are opposite to each other;

fixing a plurality of fibres of artificial material to said mat in such a way that is suitable for forming a dense turf protruding from said first face;

distributing on said first face of said mat a loose infill material, said infill material adapted to keep said fibres of artificial material substantially vertical;

introducing seeds and/or plant portions belonging to at least one vegetable species into said loose infill material;

assisting a vegetative development of said vegetable species obtaining a natural turf having roots arranged completely above said first face of said mat, said natural turf exceeding in height said synthetic turf;

whose main feature is that at least one part of said plurality of fibres of artificial material has a profiled shape comprising:

a main blade;

at least one side wing that extends from said main blade, said, or each, side wing having a curved profile and folded back towards said main blade, in order to form a channel that is substantially parallel to said main blade.

In particular, the seeds and/or the portions of plant of the vegetable species can be put on the first face of the mat in a way selected from the group comprised of:

sowing;

transplantation;

a combination thereof.

Advantageously, the step of distributing the loose infill material provides distributing at least one layer of granules of rubber, in particular rubber of vegetable origin, or synthetic rubber.

In particular, the infill layer can comprise a material of mineral origin, for example sand, or gravel.

Advantageously, the infill layer comprises an organic material of vegetable origin, said organic material of vegetable origin adapted to provide a substrate of growth of said vegetable species.

Preferably, at least one part of the fibres of artificial material protrudes at least 5 mm from the infill layer, and said vegetable species is cut at a height higher than 5 mm from the infill layer.

BRIEF DESCRIPTION OF THE DRAWINGS

The invention will be now shown with the following description of an exemplary embodiment thereof, exemplifying but not limitative, with reference to the attached drawings in which.

Figure 1:
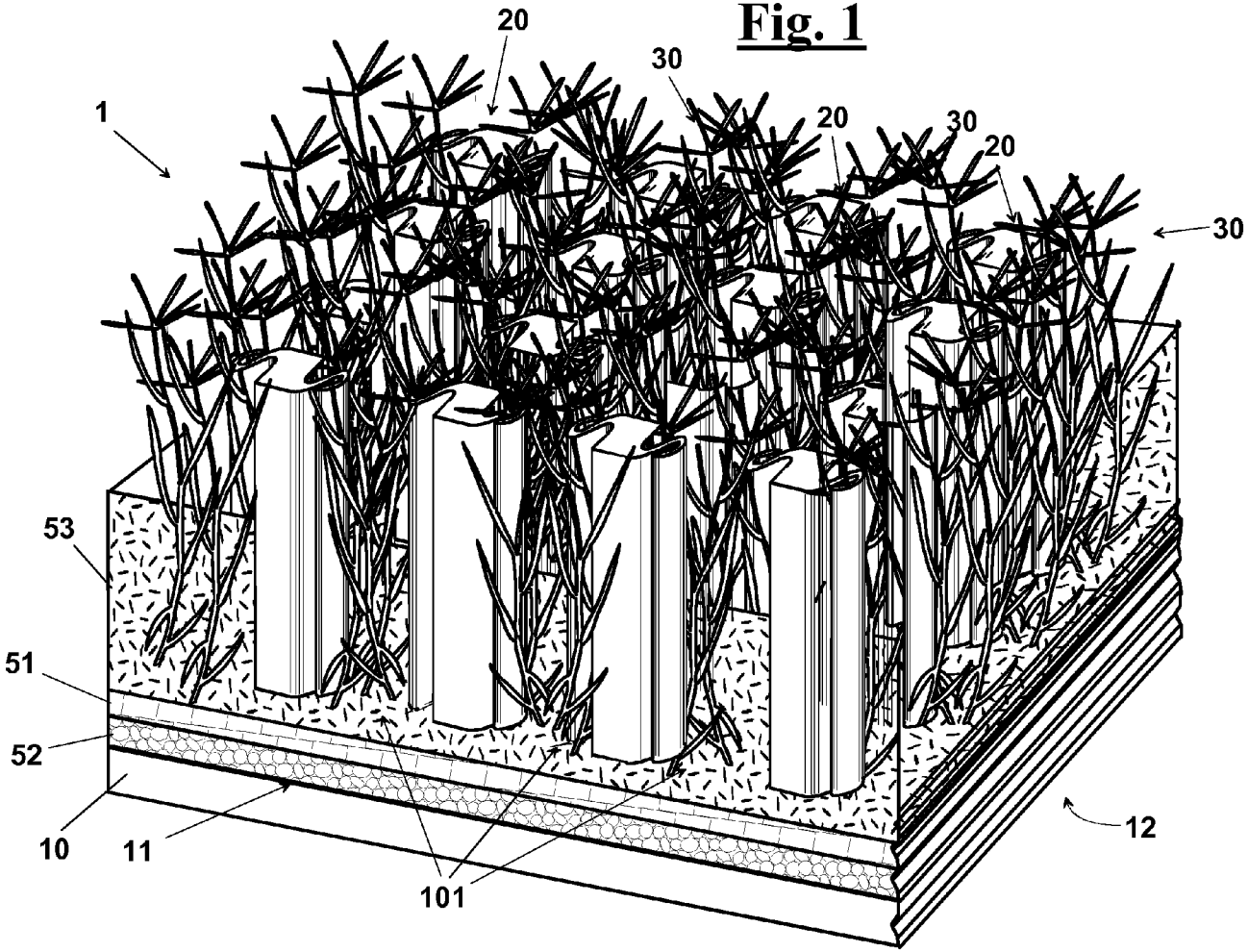
FIG. 1 diagrammatically shows a perspective view of a portion of a mixed turf, according to the present invention.

FIGS. from 2 to 6 show a cross sectional view of some exemplary embodiments of the invention for blades of artificial material provided in the mixed turf of FIG. 1;

FIGS. from 7 to 9 show diagrammatically a perspective view of some technical aspects of the fibres of artificial material provided in the mixed turf of FIG. 1;

FIGS. from 10 to 12 show cross sectional views of three possible exemplary embodiments of the mat used to provide the mixed turf of FIG. 1.

DETAILED DESCRIPTION OF THE PREFERRED EMBODIMENTS OF THE INVENTION

With reference to FIG. 1, a mixed turf 1 for sports, recreational activities and/or for ornamental purposes comprises a mat of flexible material 10 equipped with a first face 11 and of a second face 12 opposite to each other. To mat 10 a plurality of fibres 20 of artificial material are fastened, in particular by a known weaving process, in such a way that is suitable for forming an artificial turf 50 that protrudes from first face 11.

Turf 1 comprises, furthermore, a measured amount of a loose infill material 50, for example of granular type, distributed on face 11 of mat 10. In particular, the loose infill material 50 has a double function of keeping substantially vertical artificial fibres 20 and of draining turf 1.

Turf 1 is, then completed by natural vegetable material belonging to one or more plant species 30, and that can be put in the loose infill material 50 by means of sowing, transplantation of portions of plants, or a combination of the two solutions. More precisely, the vegetable species 30 roots above the mat of flexible material 10, i.e. the roots 101 of vegetable species 30 does not pass through mat 10. This way, it is possible to put mixed turf 1 on a surface of any desired type, for example of asphalt, concrete, stabilized inert material.

Furthermore, this exemplary embodiment assists the carrying mixed turf 1 by a cultivation site to an installation site.

In the exemplary embodiment shown in FIG. 1, the loose infill material 50 can comprise granules of rubber and/or of plastic material distributed on face 11 in order to form a layer 51. More in detail, the rubber can be selected from the group comprised of: natural rubber, or caoutchouc, silicon rubber, SBR, EPDM, SBS, SEBS, or a combination thereof.

The loose infill material 50 can comprise, furthermore, mineral material, such as sand, gravel, or a combination thereof. The material ore can be distributed above face 11 of mat 10 before laying the rubber material and/or plastic material, in order to form a layer 52 arranged below layer 51. Alternatively, the loose infill material 50 can be a set heterogeneous of material ore and rubber and/or plastic material.

In a further exemplary embodiment, the loose infill material 50 can comprise, furthermore, a certain an amount of organic material of vegetable origin. For example, the organic material of vegetable origin can be distributed above the layer 51 of rubber and/or plastic material, to make a layer 53 capable of creating the suitable for physical-chemical conditions for vegetative development of the plants 30. The organic material of vegetable origin may be, for example, cork, coconut fibres, agave fibres, cereal husks, for example rice husks, peat, ground wood, vegetable residues, grape seeds (seeds of *vitis vinifera*), devitalized seeds of vegetable species, agricultural and food residues, compost, organic conditioners, organic fertilizers, hoof and horn meal, roasted leather waste, vegetable waste, and normally a desired organic material of vegetable origin in granules and/or loose fibres.

According to the invention and as shown in FIGS. from 2 to 9, the fibres of artificial material 20 have a profiled shape comprising a main blade 21 and at least one side wing 22. In particular, side wing 22 comprises a proximal portion 22' connected to main blade 21, a distal portion 22" opposite to proximal portion 22' and a central portion 22'" between them. More precisely, side wing 22 has a curved profile suitable for forming a channel 25 arranged substantially parallel to main blade 21.

Figure 2:
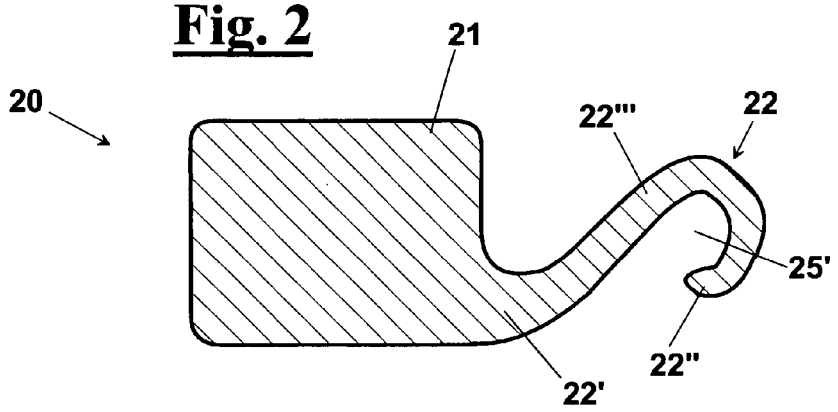

In an exemplary embodiment shown in FIG. 2, end 22" of wing 22 is provided distant from portion 22'" and from main blade 21 and therefore defines an open channel 25'.

Figure 3:
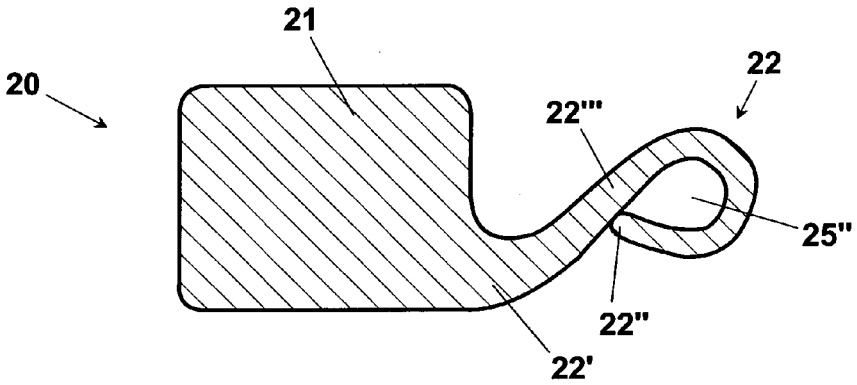

In the exemplary embodiment of FIG. 3, instead, end 22" is bent towards wing 22 up to be almost reach central portion 22'" defining, in this case, a mainly closed channel 25".

Figure 4:
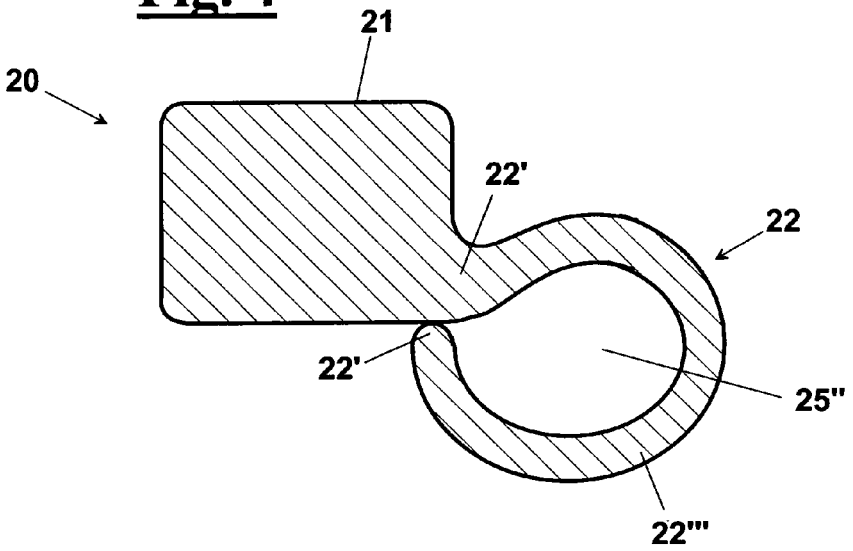

In the exemplary embodiment shown in FIG. 4, instead, end 22" is bent in order to be next to main blade 21, defining together mainly closed channel 25".

Figure 5:
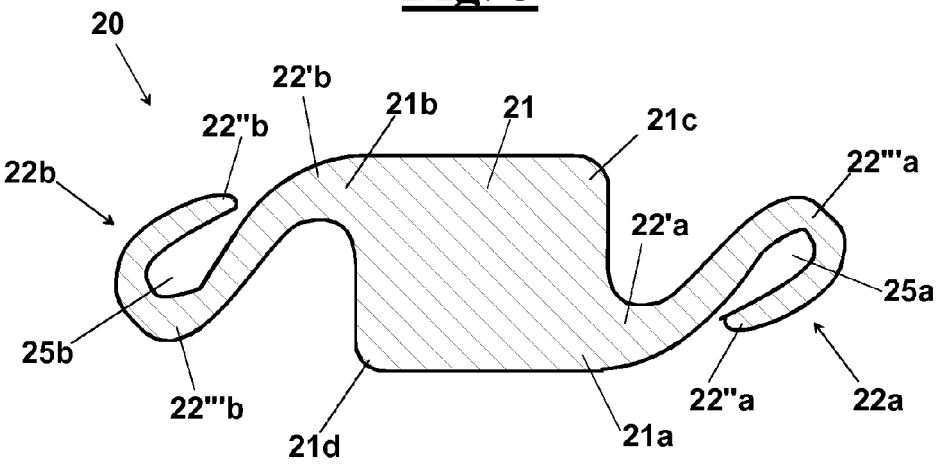
Figure 6:
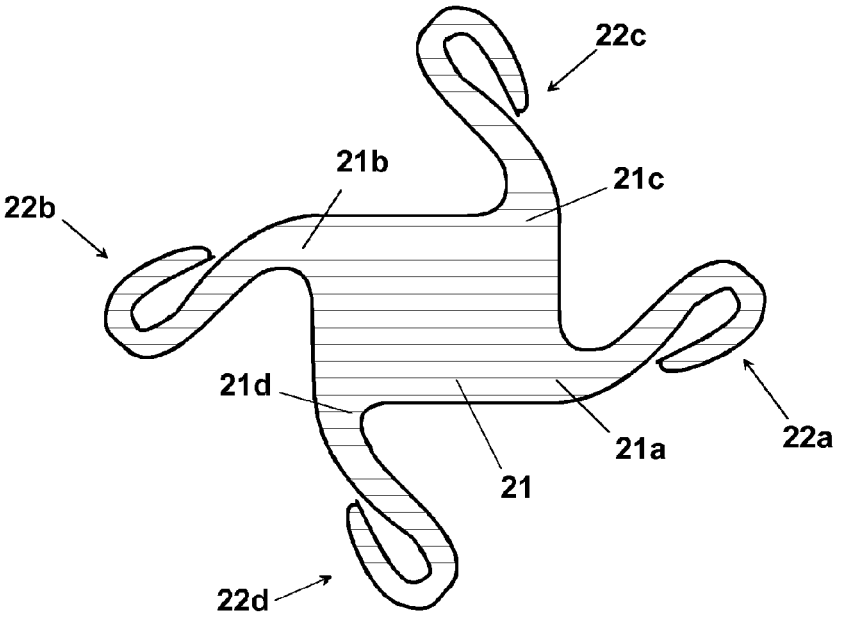

In a further exemplary embodiment of the invention and shown in FIG. 5, the artificial fibres 20 comprise a first wing 22*a* and a second wing 22*b* arranged at opposite sides with respect to main blade 21. More in detail, main blade 21 may have polygonal cross section and comprise a determined number of vertices. For example, main blade 21 may have substantially rectangular cross section with four vertices 21*a*-21*d* (FIGS. 5 and 6). In this case, wings 22*a* and 22*b* protrude from main blade 21 respectively from opposite vertices 21*a* and 21*b*. Each wing 22*a* to 22*b* defines in this case a respective channel 25*a* and 25*b* substantially parallel to main blade 21 (FIG. 5).

In the exemplary embodiment of FIG. 6, four side wings 22*a*-22*d* are provided that extend from respective vertices 21*a*-21*d* of main blade 21.

Figure 7:
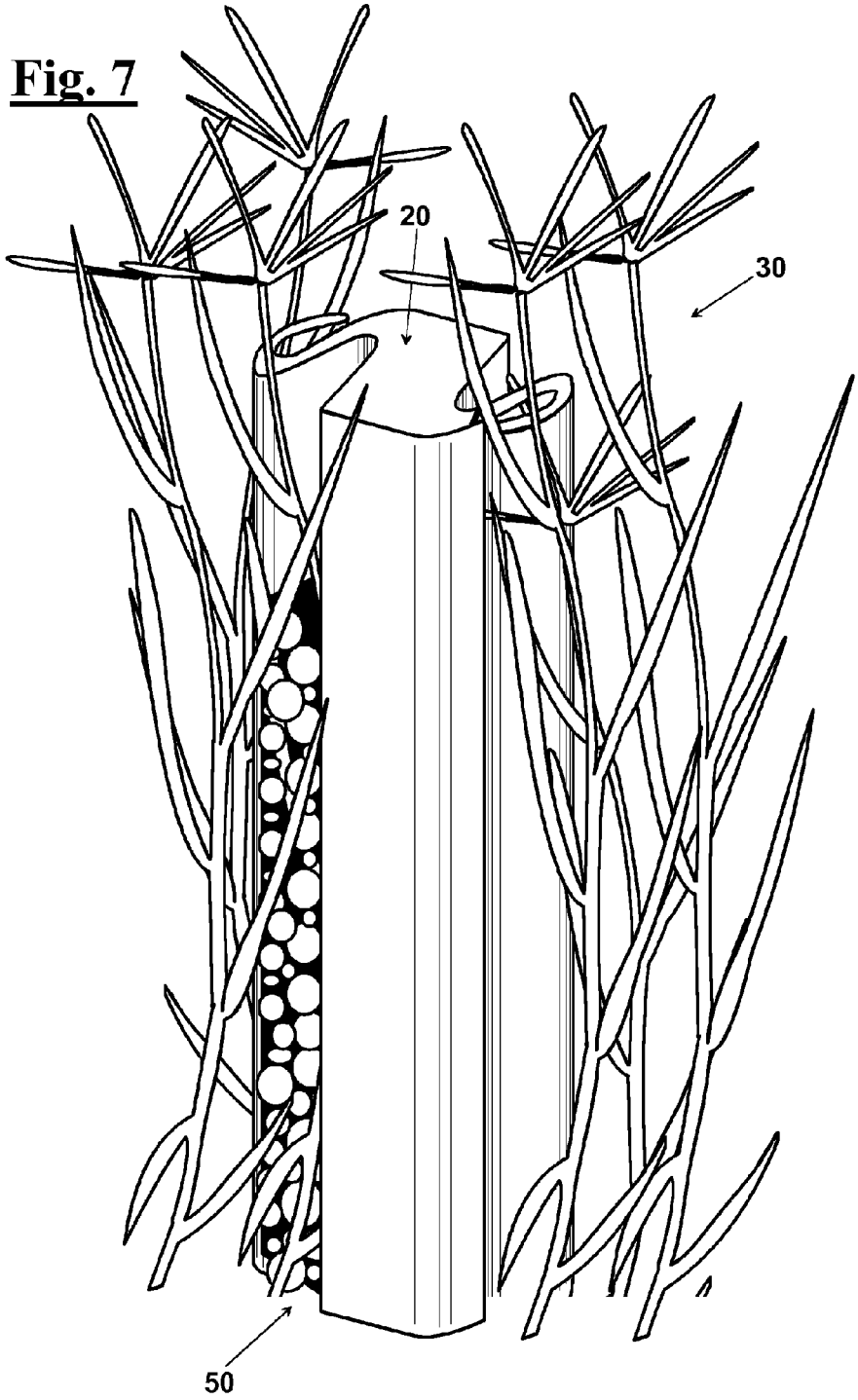

In all the different exemplary embodiments above described, channel 25 is adapted to keep a certain amount of irrigation water, or rainwater, absorbed in the loose infill material 50. This provides favourable conditions of humidity to the vegetative development of the vegetable species 30 (FIG. 7).

Figure 8:
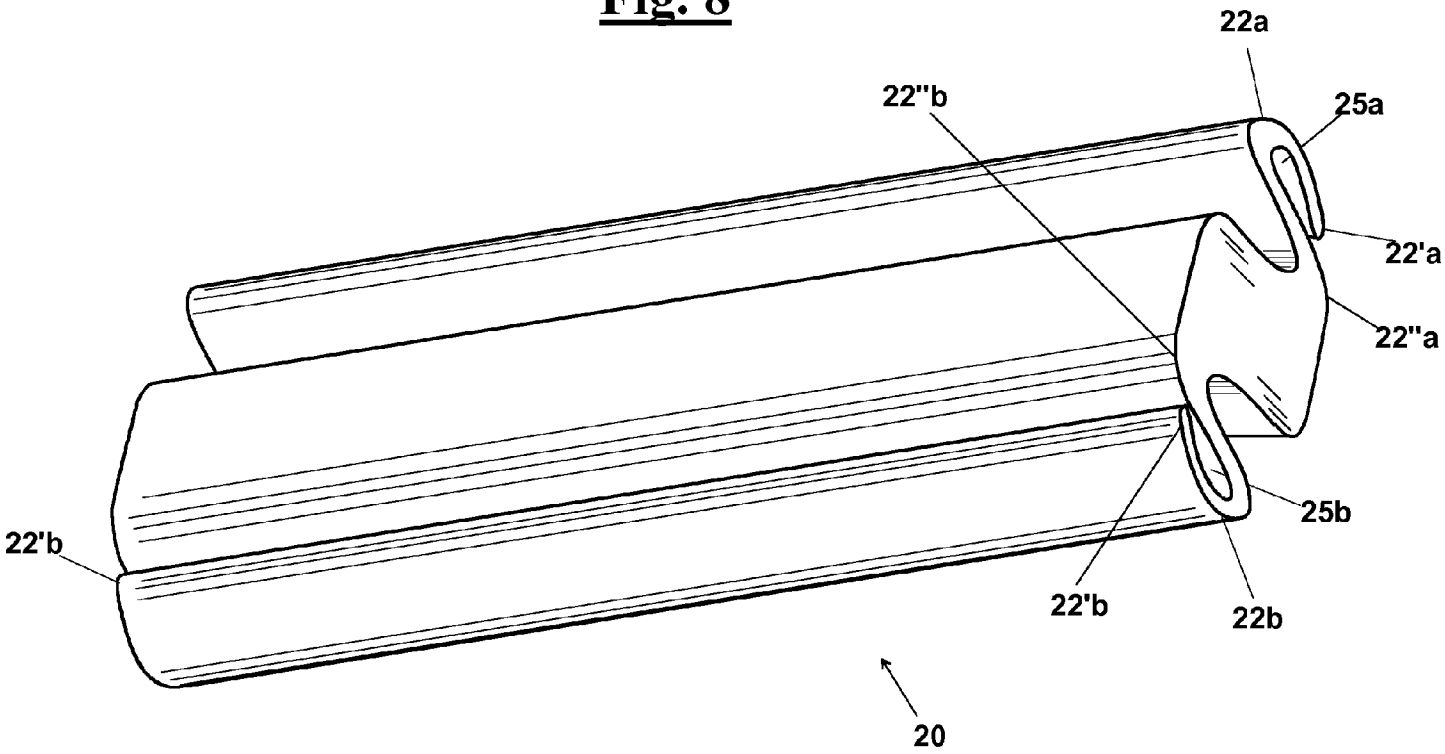
Figure 9:
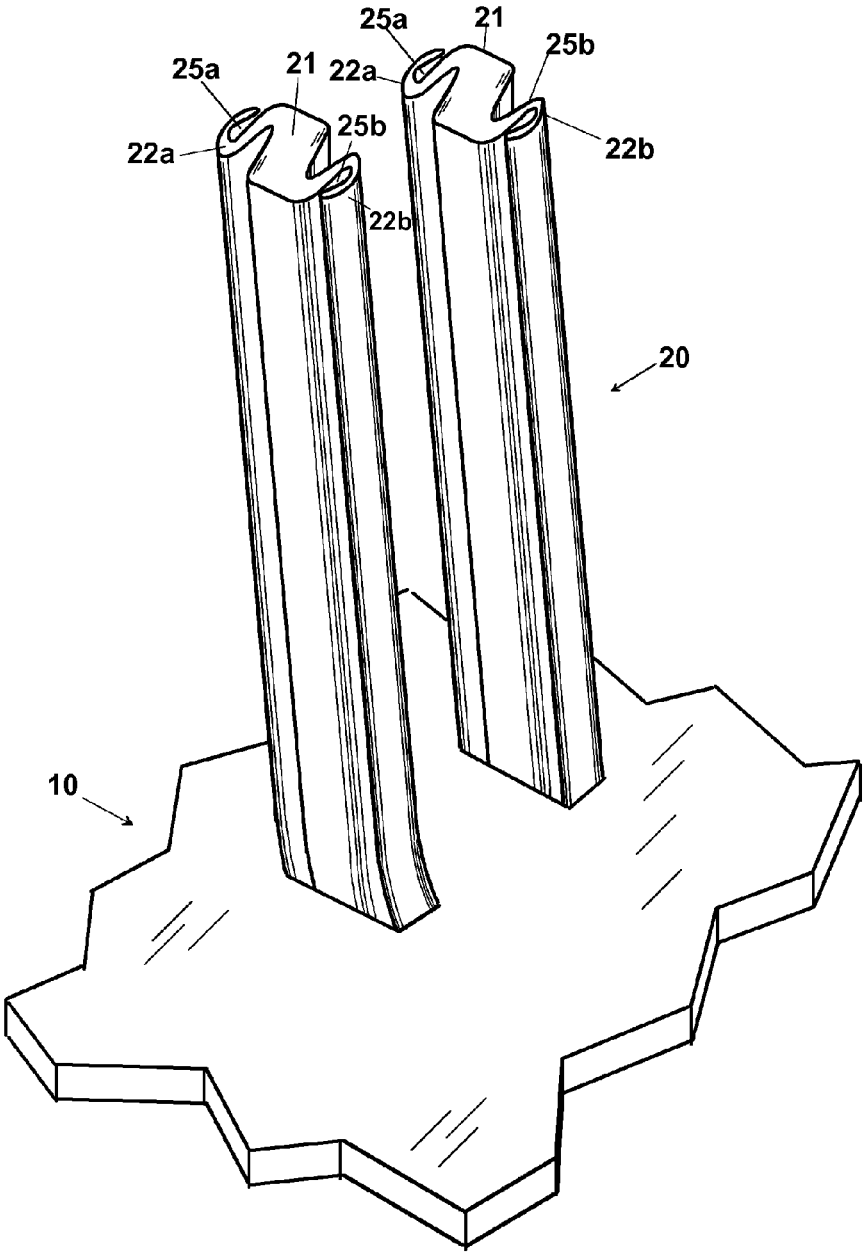
Figure 10:
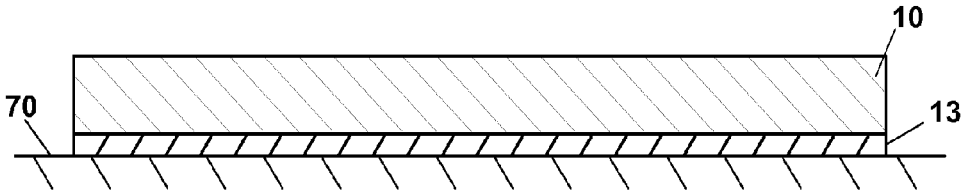

The fibres 20 are preferably obtained from a process for extrusion of plastic material using a die with a profile corresponding to the desired profile (FIG. 8). Fibres 20 of plastic material are then bent as an "U" and fixed to mat 10, for example by weaving (FIG. 9).

Figure 11:
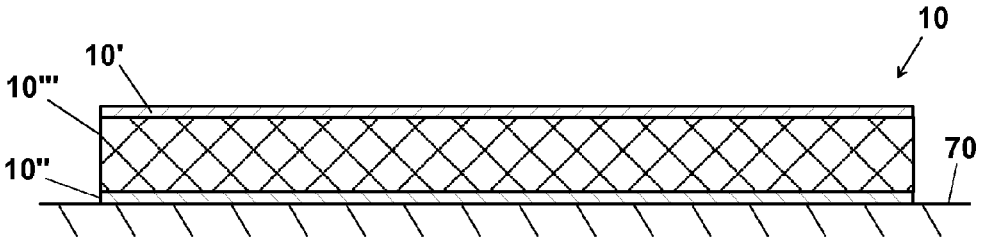

In an exemplary embodiment of the invention shown in FIG. 11 second face 12 of mat 10 is coupled to a layer of impermeable material 13 (with or without addition of a spongy material). In particular, the fibres 30 of plastic material are woven onto mat 10 forming stitches that fixed, for example embedded by spreading a layer of impermeable material 13. This can be made by a polyurethane resin that prevents water to permeate and reach the surface 70 of the cultivation site, or installation site, on which the mixed turf is arranged. Therefore, the vegetable species 30 roots exclusively above impermeable layer 13.

In the exemplary embodiment of FIG. 11 mat 10 from which the woven fibres of plastic material 30 extend comprises an upper containing layer 10', a lower containing layer 10", and a draining layer 10'" that is arranged between the layers 10' and 10" in order to keep them at a determined distance. The draining layer 10'" in addition to drain water can also have a damping effect giving to the mixed turf, according to the invention, particularly advantageous features for using the mixed turf as surface for sports activities.

Draining layer 10'" can be a three-dimensional network of randomly interwoven filaments of plastic material and capable of giving a resilient response. In particular, the filaments of plastic material may have a diameter set between 0.2 and 1.5 mm, advantageously between 0.5 and 1 mm, preferably between 0.8 and 0.9 mm.

Figure 12:
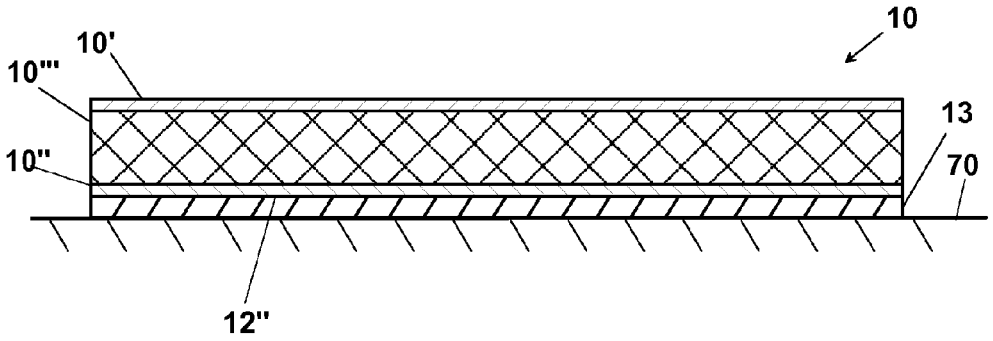

In FIG. 12, finally, a further exemplary embodiment is shown where mat 10 is made as described above with reference to FIG. 11, and furthermore a layer 13 is provided of impermeable material coupled to the lower face 12" of lower layer 10".

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Mixed turf for sports and recreational activities and/or for ornamental purposes comprising:

a mat of flexible material, said mat comprising a first and a second face that are opposite to each other;

a plurality of fibres of artificial material connected to said mat in such a way that is suitable for forming an artificial turf that protrudes from said first face;

a loose infill material distributed on said first face, said loose infill material adapted to keep said fibres of artificial material substantially vertical;

a natural turf comprising a plurality of plants belonging to at least one vegetable species, wherein said natural turf is radicated into said loose infill material between said fibres of artificial material;

wherein at least one part of said plurality of fibres of artificial material has a profiled shape comprising:

a main blade;

at least one side wing that extends from said main blade, wherein said, or each, side wing has a curved profile in order to form a channel that is substantially parallel to said main blade.

2. Mixed turf according to claim 1, wherein said channel is adapted, after filling with the loose infill material, to offer a water reserve for roots of the plants, wherein the profile of the channel partially or completely enclosing the spaces that are occupied by water, roots and loose infill material.

3. Mixed turf according to claim 1, wherein said at least one side wing, comprises, in a direction transversal to the main blade:

a proximal portion that is integral to the main blade;

a distal portion that is arranged opposite to the proximal portion;

a central portion that is set between the distal portion and the proximal portion.

4. Mixed turf according to claim 3, wherein the distal portion is adapted to be put in a position selected from the group consisting of:

a position next to said proximal portion, or to said central portion, wherein said wing defines a mainly closed channel;

a position next to said main blade, wherein said wing and said main blade define a mainly closed channel; and a position distant from the distal portion and from the central portion of the wing and from the main blade, wherein said wing defines an open channel.

5. Mixed turf according to claim 1, wherein at least one first and a second side wings are provided that extend from said main blade, said first and said second side wings defining, respectively, a first and a second channel that are arranged parallel to said main blade, wherein the first and the second face wings are arranged at opposite sides with respect to the main blade.

6. Mixed turf according to claim 1, wherein the main blade has polygonal cross section, wherein the first and the second face wings protrude from opposite vertices of the polygonal cross section of the main blade.

7. Mixed turf according to claim 1, wherein the plurality of fibres of artificial material of the artificial turf comprises:
a first plurality of linear fibres;
a second plurality of fibres having a profiled shape, and alternated to the first plurality of linear fibres.

8. Mixed turf according to claim 1, wherein the loose infill material comprises at least one of the following materials:
material in granules, or loose fibres;
elastomeric material;
organic material of vegetable origin;
mineral material;
or a combination thereof.

9. Mixed turf according to claim 8, wherein:
said organic material of vegetable origin is selected from the group consisting of: coconut fibres, rice husks, cork, and a combination thereof;
said rubber material is selected from the group consisting of: natural rubber, or caoutchouc, silicon rubber, SBR, EPDM, SBS, SEBS, TPU, and a combination thereof,
said vegetable species that is used to make the natural turf is selected from the group consisting of: a vegetable monocotyledone species; a vegetable dicotyledone species; and a combination thereof.

10. Mixed turf according to claim 8, wherein the material in granules, or loose fibres, is material of vegetable origin, or material of vegetable origins mixed with synthetic rubber.

11. Mixed turf according to claim 10, wherein the mineral material is sand, or gravel.

12. Mixed turf according to claim 8, wherein the loose infill material comprises at least one of the following layers:
a layer of rubber material;
a layer of mineral material;
a layer of organic material of vegetable origin; and
a combination thereof.

13. Mixed turf according to claim 1, wherein the mat has small drainage holes for the drainage of the rainwater, or irrigation water, that are adapted to avoid propagation of the roots through them.

14. Mixed turf according to claim 13, wherein the holes have a diameter set between 1 mm and 15 mm, advantageously between 1 mm and 10 mm.

15. Mixed turf according to claim 1, wherein second face of the mat is coupled to a layer of spongy material, said spongy material having a measured porosity through which the roots penetrate assisting the stability of the mixed turf.

16. Mixed turf according to claim 1, wherein second face of the mat is coupled to a layer of impermeable material, said impermeable layer adapted to prevent water from reaching the surface of the cultivation site, or the installation site, of the mixed turf, such that the vegetable species roots exclusively above the impermeable layer.

17. Mixed turf according to claim 1, wherein said mat comprises:
an upper containing layer;
a lower containing layer; and
a draining layer that is arranged between said upper containing layer and said lower containing layer, said draining layer distancing said upper containing layer from said lower containing layer, said fibres of artificial material being connected to said mat by weaving in order to cross said draining layer.

18. Mixed turf according to claim 17, where the draining layer is configured to provide a damping action, wherein the thickness of the draining layer provides a three-dimensional network of interwoven filaments of plastic material, so that said interwoven filaments form an open and resiliently compressible layer.

19. Mixed turf according to claim 18, wherein the filaments of plastic material have a diameter set between 0.2 and 1.5 mm.

20. A method for making a turf for sports, recreational activities, and/or for ornamental purposes, comprising the steps of:
arranging a mat of flexible material, said mat comprising a first face and a second face that are opposite to each other;
fixing a plurality of fibres of artificial material to said mat in such a way that it forms a dense turf protruding from said first face;
distributing on said first face of said mat a loose infill material, said infill material adapted to keep said fibres of artificial material substantially vertical;
introducing seeds and/or plant portions belonging to at least one vegetable species into said loose infill material;
assisting a vegetative development of said vegetable species obtaining a natural turf having roots arranged completely above said first face of said mat, said natural turf exceeding in height said synthetic turf;
wherein at least one part of said plurality of fibres of artificial material has a profiled shape comprising:
a main blade;
at least one side wing that extends from said main blade, said, or each, side wing having a curved profile that is folded back towards said main blade, in order to form a channel that is substantially parallel to said main blade, so that said channel is adapted, after filling with the loose infill material, to offer a water reserve for roots of the plants, wherein the profile of the channel partially or completely enclosing the spaces that are occupied by water, roots, and loose infill material.

* * * * *